US006363563B1

(12) United States Patent
Range et al.

(10) Patent No.: US 6,363,563 B1
(45) Date of Patent: Apr. 2, 2002

(54) USER OBSERVATION CYCLE FOR AN AUTOMATIC WASHER

(75) Inventors: Michael E. Range, Stevensville; Scot S. Lau, St. Joseph, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/557,124

(22) Filed: Apr. 25, 2000

(51) Int. Cl.[7] ..... D06F 33/02; D06F 37/42

(52) U.S. Cl. ..... 8/159; 68/12.02; 68/12.12; 68/12.14; 68/12.26

(58) Field of Search ..... 8/159; 68/12.01, 68/12.02, 12.12, 12.14, 12.26

(56) References Cited

U.S. PATENT DOCUMENTS

| | | | | | |
|---|---|---|---|---|---|
| 5,460,018 | A | | 10/1995 | Werner et al. | 68/23.6 |
| 5,742,964 | A | * | 4/1998 | Choi | 8/159 |
| 5,870,787 | A | * | 2/1999 | Choi | 8/159 |
| 5,913,952 | A | * | 6/1999 | Kim | 68/12.02 X |

* cited by examiner

*Primary Examiner*—Philip Coe
(74) *Attorney, Agent, or Firm*—Thomas J. Roth; Robert O. Rice; Stephen Krefman

(57) ABSTRACT

An automatic washer includes a control which allows the user to observe the operation of the washer under a set condition or conditions. When these conditions are met, the user may open the door or lid of the washer and observe, for a predetermined period of time, the wash activity. After reclosing the door or lid, the washer may be restarted to continue the wash cycle.

9 Claims, 9 Drawing Sheets

USER OBSERVATION CYCLE FOR AN AUTOMATIC WASHER

BACKGROUND OF THE INVENTION

1. Field of the Invention

The invention relates to an automatic cycle for an automatic washer, and more particularly a cycle feature allowing a user or operator to observe washer activity under particular conditions.

2. Description of Related Art

Automatic controls for washing machines have long included the use of a door or lid switch as an input to the control in order to vary the action of the washing machine. Commonly, in a top-loading washer known to the industry as a vertical axis washer, the lid switch detects the opening of the lid during a portion of the wash cycle. This information has been used to meet the industry requirement that a washer must shut down when the lid is opened during a spin portion of a cycle, for example. Also, this information may be used to shut down the washer or terminate other washer functions if the lid is opened during fill, wash, rinse or drain.

The automatic washer category also includes front-opening washers, also known as horizontal axis or tilt axis washers. In these washers as well, information from a door switch communicating the open or closed status of the door may be used to affect the function or steps of the washer.

Although it is known to provide a lid or door switch control input, in previous automatic washers the input has been used, or not used, as a simplistic input used to enable means to shut off some or all washer functions depending on the progression of the cycle. For previous purposes as mentioned herein, this function may have been satisfactory in the past. However, a drawback to these controls is the inability of the user or operator to open the lid or door, while under certain conditions, to allow the user to observe the continuing operation of the washer for a predetermined time period, thereafter at least temporarily ceasing washer functions.

Accordingly, there is a need for a control for an automatic washer which allows the user or operator to open the lid or door, to allow the user to observe the continuing operation of the washer for a predetermined time period, while under certain conditions such as for example, when the washer is not operating in a spin mode, thereafter at least temporarily ceasing washer functions.

SUMMARY OF THE INVENTION

The present invention is directed to a control for an automatic washer which allows a user or operator to observe washer activity under particular conditions. A control for an automatic washer detects the opening of a washer door through use of a door switch signal. The control determines whether one or more conditions exist which preclude further washer operation, and if no such condition exists, the control provides a predetermined time period for additional washer operation following said determining step, followed by a ceasing at least temporarily of washer functions.

In an aspect of the present invention, upon detecting the opening of the washer door, the control discontinues water pumping or draining during a predetermined time period.

In another aspect of the present invention, upon detecting the opening of the washer door, the control pauses a cycle timer of the automatic washer for a predetermined time period. The predetermined pause time period may be fixed (a constant time period) or variable (washer restart occurs upon user closing of the lid or closing of the lid and pressing a start/continue button) or a combination of the two.

In another aspect of the present invention, upon detecting the opening of a washer door through use of a door switch, determining whether a washer motor is operating to perform a basket spin, and if the basket spin condition is detected, immediately discontinuing operation of said motor.

In yet another aspect of the present invention, upon determining that the washer is not performing a basket spin, detecting whether bleach has been dispensed within said washer, whereupon if such bleach dispensing step is detected to have been performed, immediately discontinuing operation of said motor.

In a further aspect of the present invention, upon determining that no conditions exist which preclude further washer operation, the washer continues to operate for a predetermined additional time period. The additional washer operation is to allow the user or consumer to view the functioning of the washer for a selected period of time. This additional washer operation is approximately five seconds, after which time the washer discontinues operation.

In a further aspect of the present invention, upon expiration of a predetermined time period, the control recommencing washer functions upon reclosure of the washer door.

In yet a further aspect of the present invention, after ceasing at least temporarily all washer functions upon expiration of said predetermined time period, the control recommences washer functions upon reclosure of said washer door and pressing of a user-controlled start/continue button.

DESCRIPTION OF THE PREFERRED EMBODIMENTS

The present invention may be beneficially employed with any type of known automatic washing machine, such as a conventional vertical axis washer with a nutator, agitator, impeller or other wash means, or in a horizontal or tilt-axis washer. For the purpose of this Description, the terms "nutator", "nutate" and "nutating" will be used as a convenient but non-limiting example. For the purpose of understanding and disclosing the invention in a specific example of an automatic washer, U.S. Pat. No. 5,460,018 entitled "Vertical Axis Washer", Werner et al., inventors and assigned to Whirlpool Corporation, is hereby incorporated as if fully set forth herein. While it is understood that horizontal and tilt-axis automatic washers may not have the same wash motions or agitation techniques as vertical axis washers, the present invention is nevertheless applicable to such washers.

Figure 1:
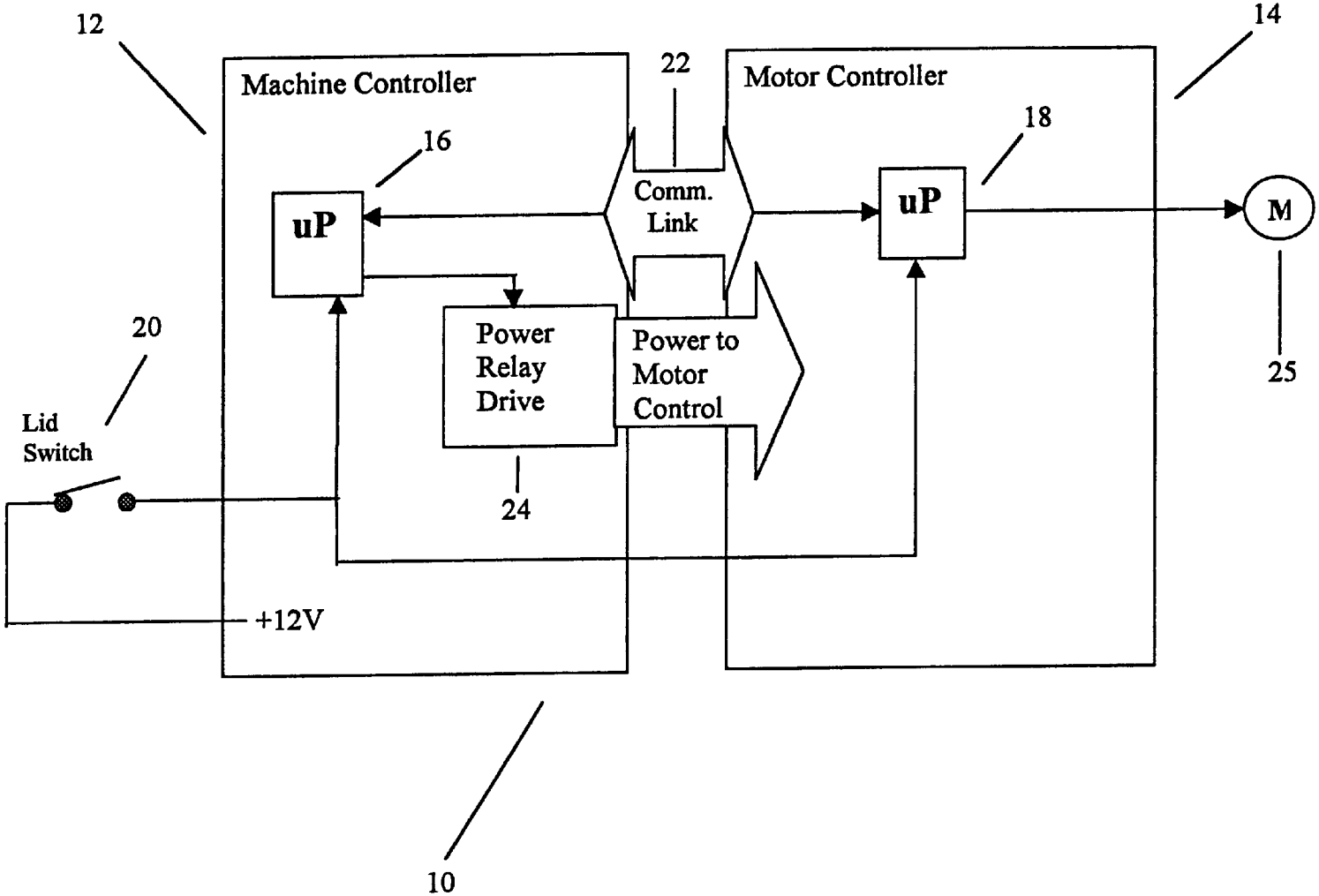
FIG. 1 is a schematic diagram of the automatic washer control.

Referring now to FIG. 1 of the drawings, an automatic washer control 10 includes a machine controller 12 and a motor controller 14, each having a microprocessor 16 and 18, respectively. Motor controller 14 provides control inputs to motor 25. A door or lid switch 20 on a low voltage circuit such as a 12 volt circuit is employed to signal a door open status to both microprocessors.

Accordingly, the door switch acts an input to both machine controller 12 and motor controller 14. Machine controller 12 has two ways to shut the motor controller down. The first way is to send an OFF command via the communications link serial corn 22, and the second way is to shut down power to the motor controller 14 via a power relay drive 24, which is directly controlled by the machine controller microprocessor 16. In order for the washer to operate in a user observation mode, both microprocessors must agree on the door open status, direction of the motor 25 and speed. If the motor controller 14 reads the door switch 20 as being in the open state, it will ignore any machine control commands to start the motor and will shut down the motor either after the user observation cycle or immediately if the motor is in spin or non-nutate mode.

Figure 2:
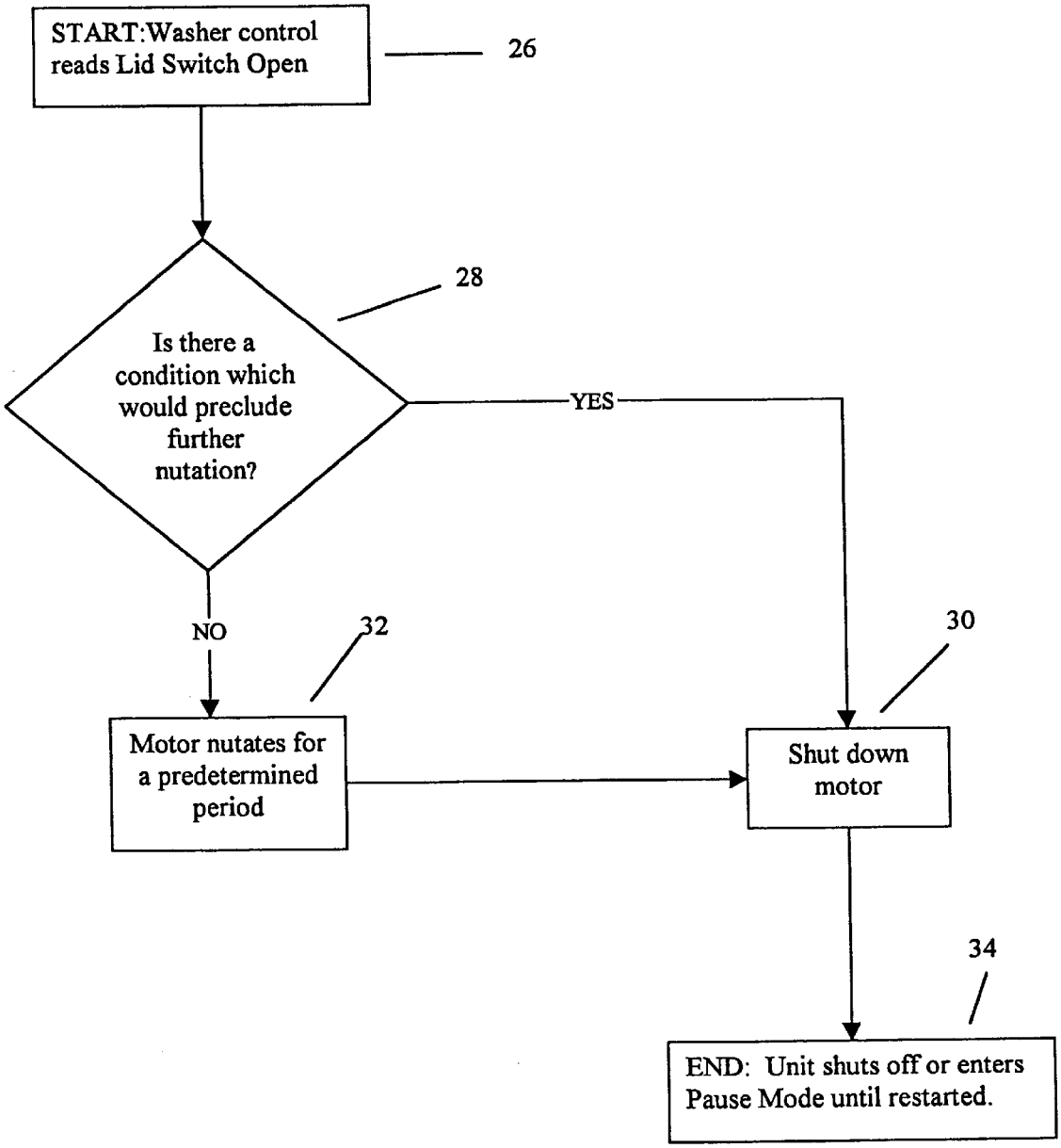
FIGS. 2–9 are flow charts portraying embodiments of the invention.

Turning now to FIG. 2 and subsequent figures, there are disclosed a variety of embodiments of a control arrangement for a user observation mode for an automatic washer. In FIG. 2, the control determines whether to enter a user observation following a lid switch open signal 26, i.e. a lid open indication. The control then queries whether there exists a condition which would preclude further nutation 28, and if so commands a motor shutdown 30. If there exists no such condition 28, then the motor nutates for a predetermined period 32 prior to motor shutdown 30. In either case, the control ends by shutting off the automatic washer or entering a pause mode until restarted 34. The washer may be restarted by use of a timer or some other restart means. FIG. 2 therefore sets forth a basic version of the invention wherein a user or consumer may open the lid and briefly observe the operation of the washer under certain conditions.

Figure 3:
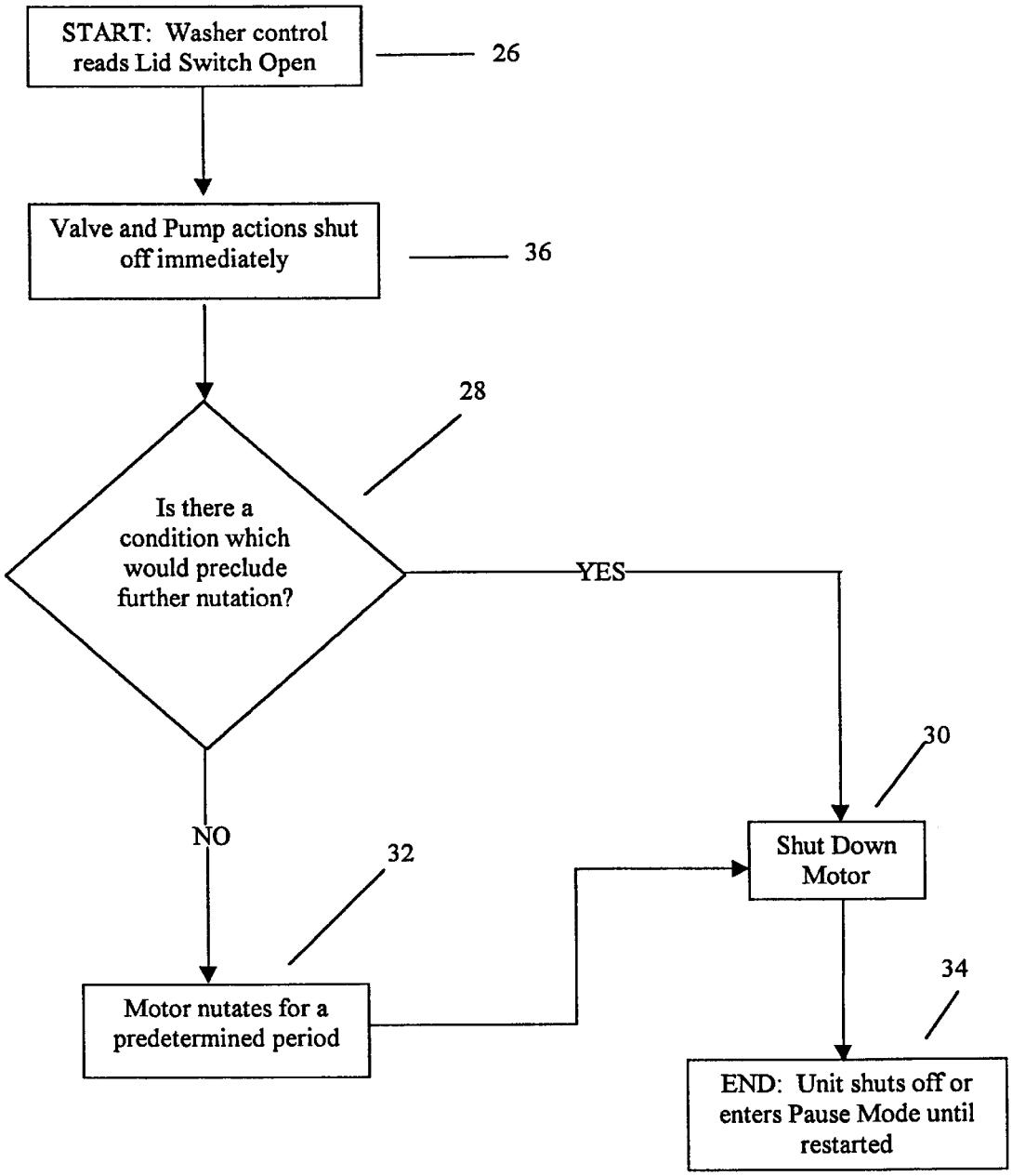
Figure 4:
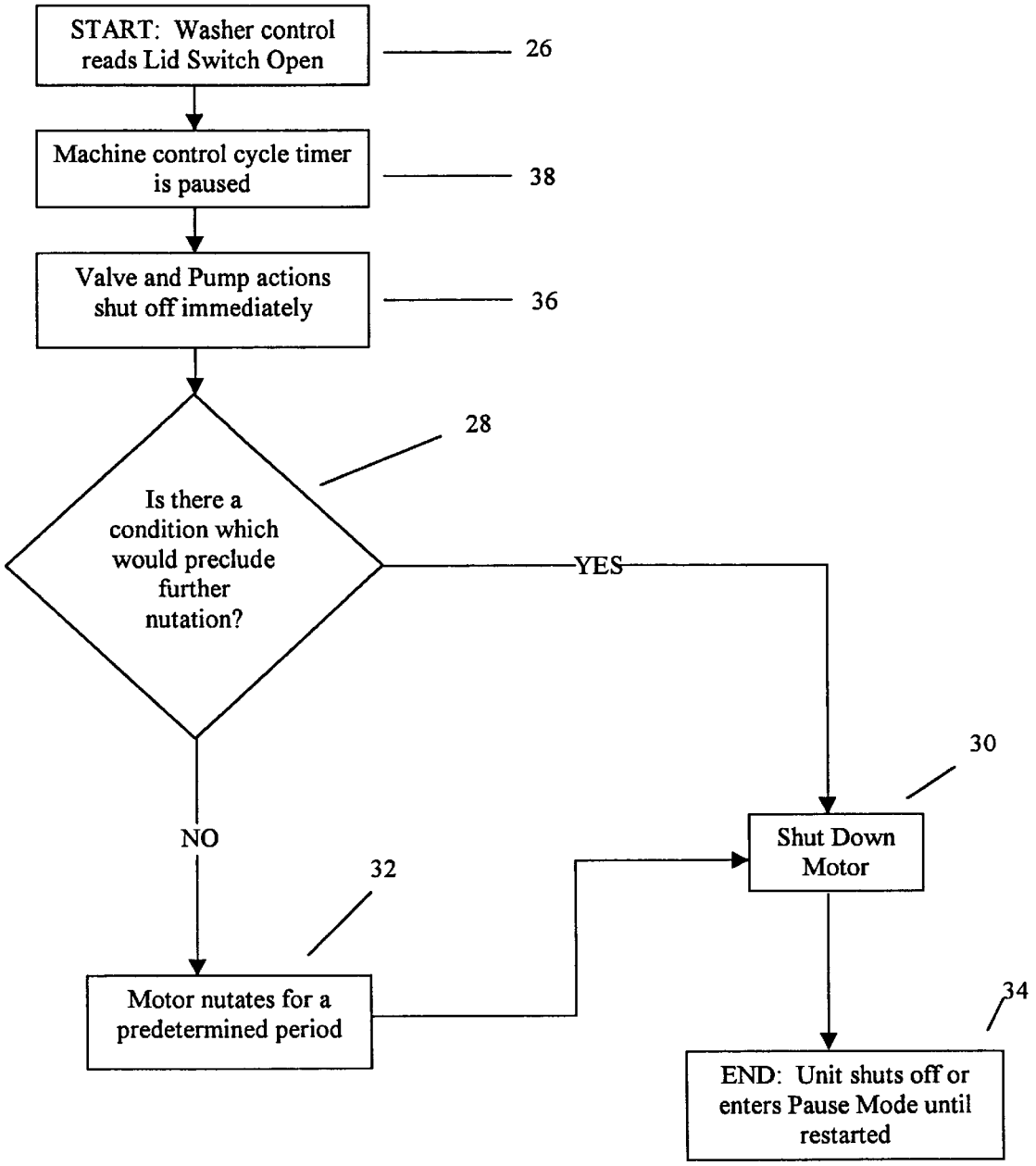

As set forth in FIG. 3, the control provides for immediately shutting off all valve and pump actions 36 upon opening of the lid 26, in order to prevent unneeded splashing or water action. In FIG. 4, the control, in addition to shutting off all valve and pump actions 36, will pause the cycle timer 38 upon opening of the lid switch 26. The cycle timer is paused so that if the washer is restarted, the control may recommence the cycle where it left off for the same time as if the lid had not been opened.

Figure 5:
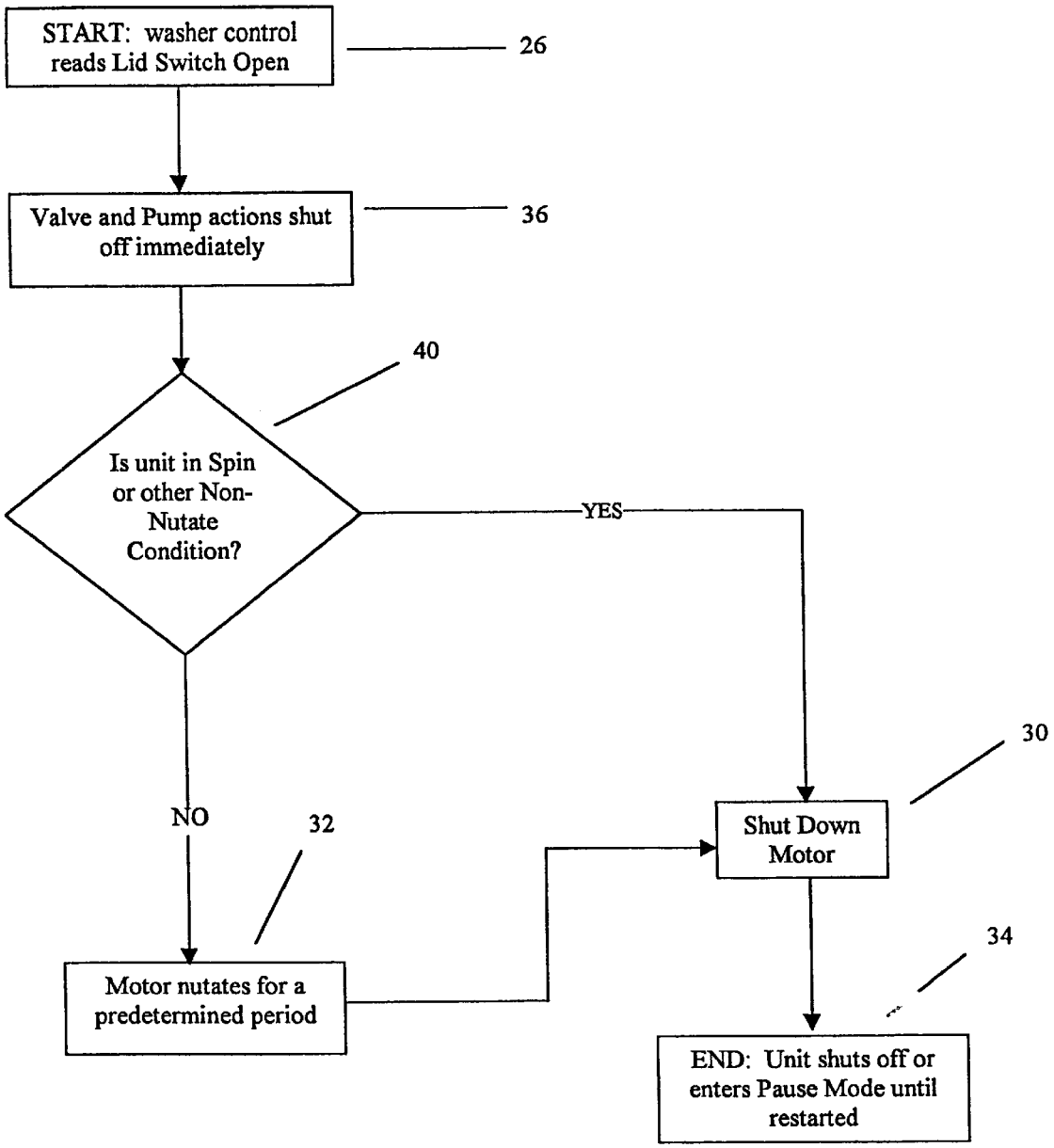
Figure 6:
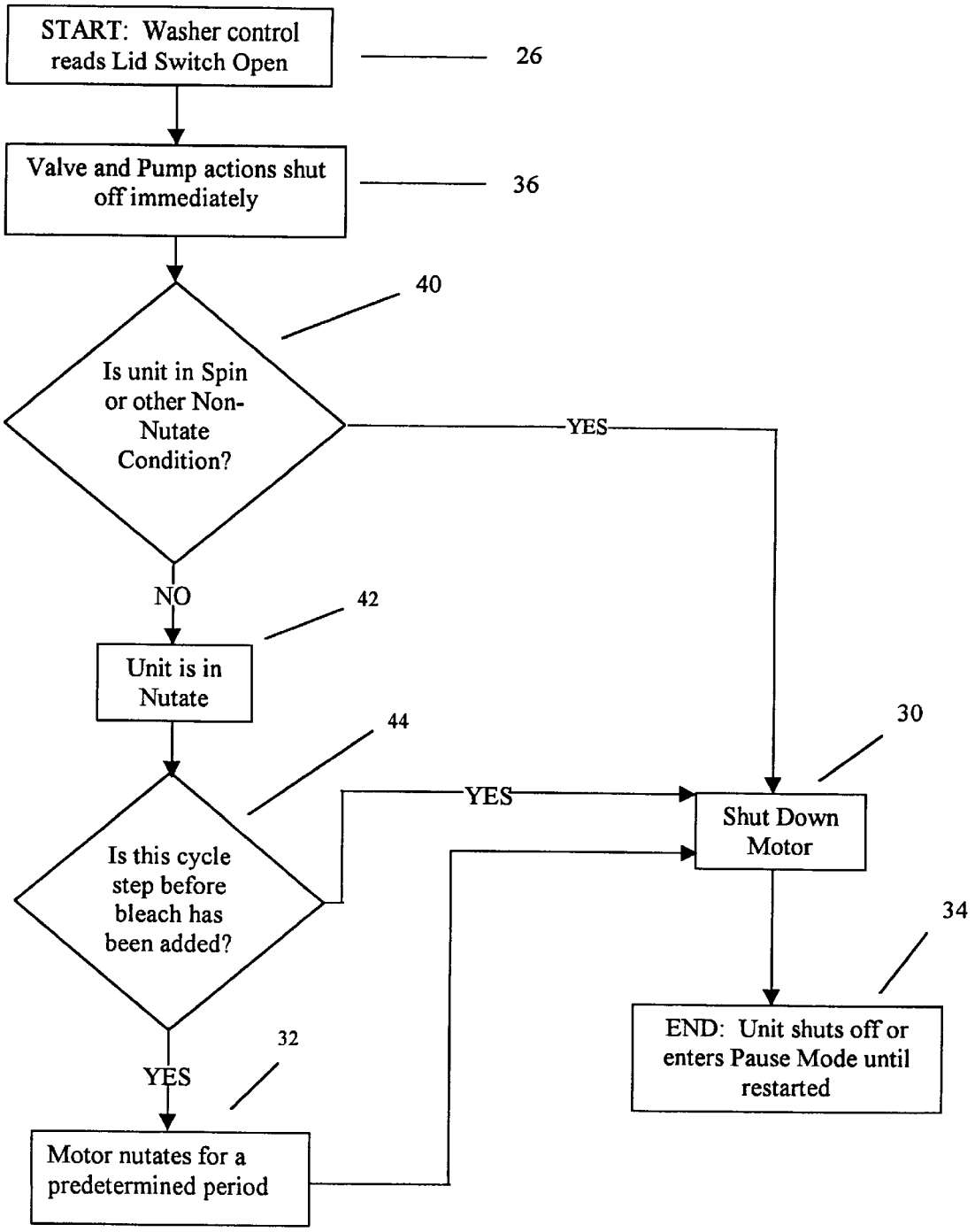

In FIG. 5, the control progresses as set forth in FIG. 3, however the condition which would preclude further nutation 28 is limited to one condition query, i.e. is the unit in spin or another non-nutate condition. In FIG. 6, the control progresses as set forth in FIG. 5, however if the answer to the initial query 40 is that the unit is in nutate 42, then a second condition query is included, whether this cycle step is before bleach has been added 44. This query may ensure that the user is not inadvertently exposed to a nutating washer having bleach therein.

Figure 7:
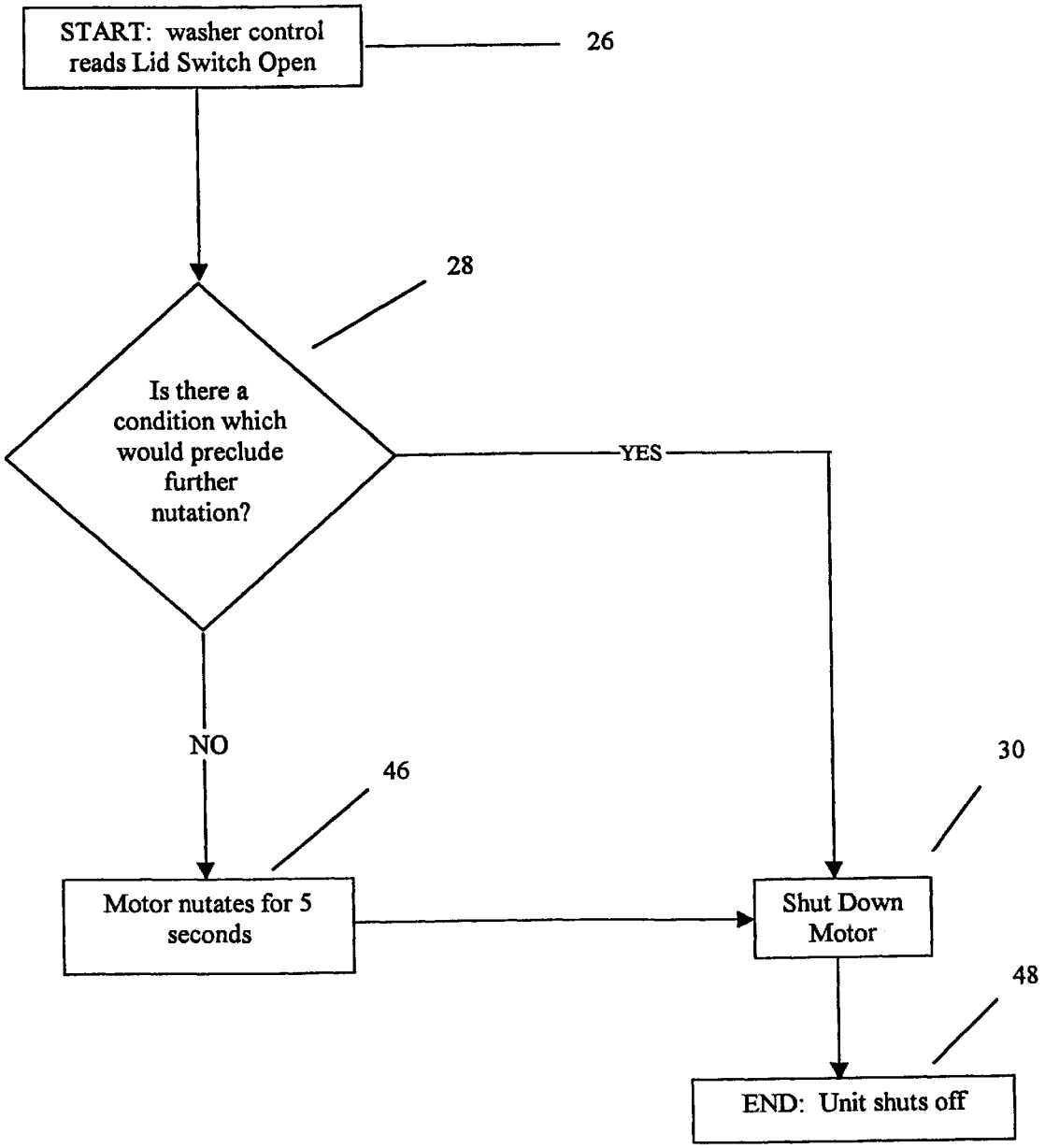
Figure 8:
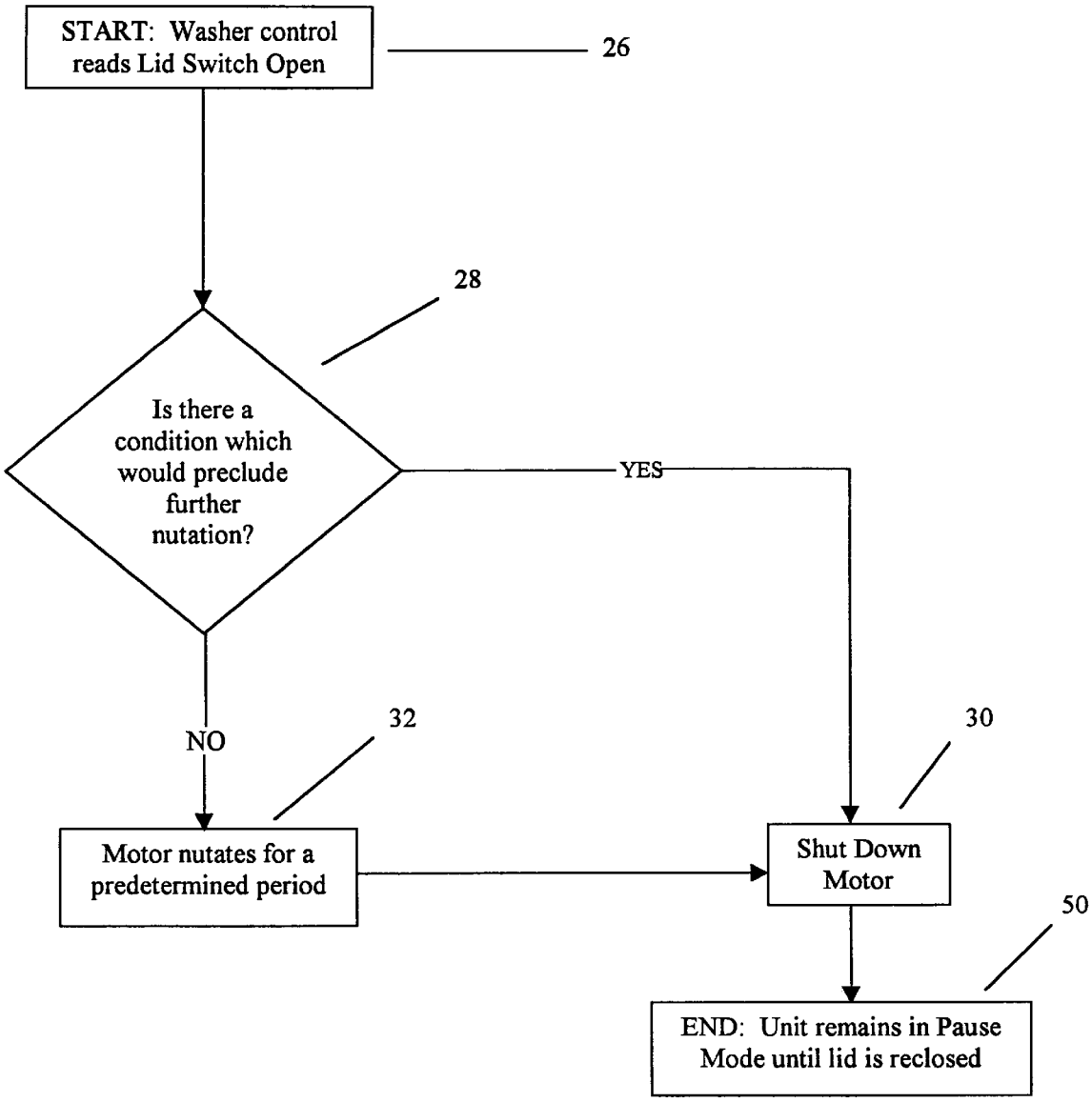

Referring now to FIG. 7, the control follows the query whether there is a condition which would preclude further nutation 28 with a 5 second nutation. The cycle ends by shutting off the motor 30 and the unit shuts off 48. In FIG. 8, after the query whether there is a condition which would preclude further nutation 28, there follows a nutation for a predetermined period 31 and a motor shut-down 30, completed by the unit remaining in Pause Mode until the lid is reclosed 50. This last step allows the user to recommence washer operations by merely dropping the washer lid or closing the door.

Figure 9:
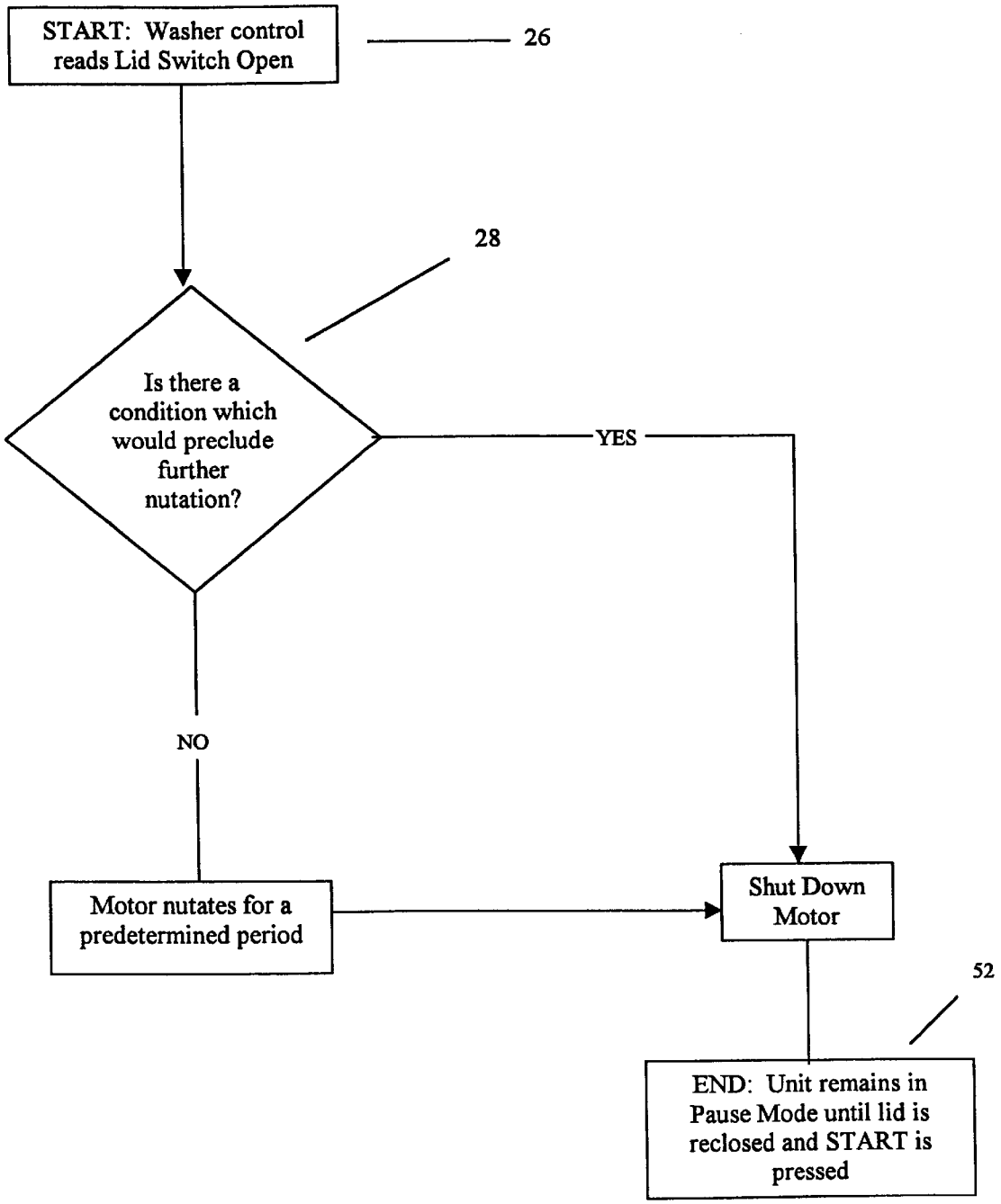

Finally, in FIG. 9, after the query whether there is a condition which would preclude further nutation 28, there follows a nutation for a predetermined period 32 and a motor shut-down 30, completed by the unit remaining in Pause Mode until the lid is reclosed and START is pressed 52.

While the present invention has been described with reference to the above described embodiments, those of skill in the art will recognize that changes may be made thereto without departing from the scope of the invention as set forth in the appended claims.

What is claimed is:

1. An automatic washer having a control method comprising:

detecting the opening of a washer door through use of a door switch signal, determining whether one or more conditions exist which preclude further washer operation, and if no such condition exists, providing a predetermined time period for additional washer operation following said determining step, followed by ceasing at least temporarily washer functions upon expiration of said predetermined time period.

2. The automatic washer set forth in claim 1, further comprising:

discontinuing water pumping or draining during said predetermined time period.

3. The automatic washer set forth in claim 2, further comprising:

pausing a cycle timer of automatic washer until the washer is restarted.

4. The automatic washer set forth in claim 2, further comprising:

upon detecting the opening of a washer door through use of a door switch, determining whether a washer motor is operating to perform a basket spin, whereupon if said basket spin condition is detected, immediately discontinuing operation of said motor.

5. The automatic washer set forth in claim 4, further comprising:

upon determining that the washer is not performing a basket spin, detecting whether bleach has been dispensed within said washer, whereupon if such bleach dispensing step is detected to have been performed, immediately discontinuing operation of said motor.

6. The automatic washer set forth in claim 1, further comprising:

upon determining that no conditions exist which preclude further washer operation, said predetermined time period for additional washer operation is approximately five seconds, after which time said automatic washer discontinues operation.

7. The automatic washer set forth in claim 1, further comprising:

after ceasing at least temporarily all washer functions upon expiration of said predetermined time period, recommencing washer functions upon reclosure of said washer door.

8. The automatic washer set forth in claim 1, further comprising:

upon expiration of said predetermined time period, recommencing washer functions upon reclosure of said washer door and pressing of a user-controlled start/continue button.

9. The automatic washer set forth in claim 1, where in the detecting step further comprises:

providing a machine controller and a motor controller, each of which detects the opening of a washer door through use of a door switch signal, wherein only when both the machine controller or the motor controller detect the opening of a washer door, the automatic washer control proceeds to perform the remaining steps.

* * * * *